US009010997B2

(12) United States Patent
Sumida et al.

(10) Patent No.: US 9,010,997 B2
(45) Date of Patent: Apr. 21, 2015

(54) ELECTRONIC TIMEPIECE

(75) Inventors: Tatsuo Sumida, Iruma (JP); Moto Yamashita, Hachioji (JP)

(73) Assignees: Citizen Holdings Co., Ltd., Tokyo (JP); Citizen Watch Co., Ltd., Tokyo (JP)

( * ) Notice: Subject to any disclaimer, the term of this patent is extended or adjusted under 35 U.S.C. 154(b) by 29 days.

(21) Appl. No.: 13/577,082

(22) PCT Filed: Mar. 14, 2011

(86) PCT No.: PCT/JP2011/055930

§ 371 (c)(1),
(2), (4) Date: Aug. 3, 2012

(87) PCT Pub. No.: WO2011/115051

PCT Pub. Date: Sep. 22, 2011

(65) Prior Publication Data

US 2012/0300597 A1 Nov. 29, 2012

(30) Foreign Application Priority Data

Mar. 15, 2010 (JP) ..... 2010-057760

(51) Int. Cl.
*G04B 37/04* (2006.01)
*G04C 3/14* (2006.01)
*G04D 5/00* (2006.01)

(52) U.S. Cl.
CPC . *G04C 3/143* (2013.01); *G04D 5/00* (2013.01)

(58) Field of Classification Search
USPC ..... 368/322–326, 316–318, 155; 29/896.31, 896.3
See application file for complete search history.

(56) References Cited

U.S. PATENT DOCUMENTS

| | | | | |
|---|---|---|---|---|
| 4,086,753 | A * | 5/1978 | Tsuchiya et al. | 368/156 |
| 4,143,511 | A * | 3/1979 | Bachmann | 368/326 |
| 4,217,753 | A * | 8/1980 | Loretan | 368/324 |
| 6,012,838 | A * | 1/2000 | Hara et al. | 368/322 |
| 6,120,177 | A * | 9/2000 | Hara et al. | 368/149 |
| 6,183,125 | B1 * | 2/2001 | Hara et al. | 368/322 |

FOREIGN PATENT DOCUMENTS

| | | | |
|---|---|---|---|
| JP | 50-154410 | U | 12/1975 |
| JP | 60-5738 | Y2 | 4/1976 |
| JP | 2002-90473 | A | 3/2002 |
| JP | 2003-337181 | A | 11/2003 |

* cited by examiner

*Primary Examiner* — Sean Kayes
(74) *Attorney, Agent, or Firm* — Foley & Lardner LLP

(57) ABSTRACT

Lubricating apparatuses (10, 20, 30, 40) that support the axes of a stator guide (70) and a rotor (50) fit into an opening of a stator (60) are separate components and by fitting the stator guide (70) and lubricating apparatuses (10, 20, 30, 40) into the cylindrically shaped opening of a constant diameter disposed in a bottom plate (80), a bearing can be configured that aligns the central axis of the opening of the stator (60) and the rotational axis of the rotor (50) with high precision. Additionally, the structure of the lubricating apparatus (10, 20, 30, 40) is simplified and configures an electronic timepiece that can use the bearing-less stator (60).

4 Claims, 2 Drawing Sheets

ELECTRONIC TIMEPIECE

TECHNICAL FIELD

The present invention relates to bearing structure of a rotor of an electronic timepiece having at least the rotor and a stator.

BACKGROUND ART

Conventionally, electronic timepieces with a rotor that rotates 1 or more times in 1 second, have a lubricating apparatus that is a mechanism for maintaining lubrication and for supporting in the bearing of the rotor having a high rotation count, the staff of the rotor. Further, the staff center of the rotor and the center of the opening of the stator are aligned with high precision by positioning the opening of the stator with an outer perimeter of a substantially cylindrically shaped guide extending from the substantially cylindrically shaped lubricating apparatus (see, for example, Patent Document 1).

Patent Document 1 Japanese Laid-Open Patent Publication No. 2003-337181 (FIG. 4)

DISCLOSURE OF INVENTION

Problem to be Solved by the Invention

With the conventional technology, since the stator guide is integrated in the lubricating apparatus, which is the bearing of the rotor, the staff center of the rotor and the center of the opening of the stator can be aligned with high precision. However, the lubricating apparatus, which has a substantially cylindrically shaped member that is a primary member forming the lubricating apparatus, has one end that has a complicated structure to support multiple members supporting lubrication and another end that is a guide structure fit with the opening of the stator and having is a complicated shape. Thus, a problem arises in that the processing for the lubricating apparatus is difficult.

A further problem arises in that, for the lubricating apparatus, which has a guide-shape that is fit into the opening of the stator, the number of types of bearing components increases since the same bearing component cannot be used for the bearing on the side where the stator is disposed and for the bearing (reference numerals 118, 119 in Patent Document 1) on the opposite side.

In light of the foregoing, one object of the present invention is to provide an electronic timepiece that has a simple shape and an facilitate processing.

A further object of the present invention is to provide an electronic timepiece that can prevent increases in the component types.

Means for Solving Problem

To solve the problems above and achieve an object, the electronic timepiece according to the invention has at least a rotor and a stator, and includes a lubricating apparatus that is has a substantially cylindrical shape and disposed as a bearing of the rotor and for holding lubricant; a stator guide that has a substantially cylindrical shape and is for maintaining a position of the stator; an opening that has a substantially cylindrical shape, is for fitting and fixing the lubricating apparatus and the stator guide such that respective central axes are aligned, and is disposed in a bottom plate that is a primary member of the electronic timepiece, where an outer diameter at a joint of the lubricating apparatus fitted into the opening and an outer diagram at a joint of the stator guide fitted into the opening differ.

In the electronic timepiece according to the invention above, the lubricating apparatus is disposed in plural in electronic timepiece, and the rotor uses at least 2 of lubricating apparatuses as the bearing.

Further, in the electronic timepiece according to the invention above, any one among the lubricating apparatus and the stator guide is fit into the opening first and the outer diameter at the joint of the other fit subsequently is greater than the outer diameter at the joint of the one fit first.

In the electronic timepiece according to the invention above, the one fit into the opening first is the lubricating apparatus and the other fit subsequently is the stator guide.

Effect of the Invention

The electronic timepiece according to the present invention effects a simple shape and facilitates processing.

The electronic timepiece according to the present invention further prevents increases in component types.

BEST MODE(S) FOR CARRYING OUT THE INVENTION

With reference to the accompanying drawings an embodiment of an electronic timepiece according to the present invention will be described in detail. Nonetheless, the present invention is not limited by the embodiment.

Figure 1:
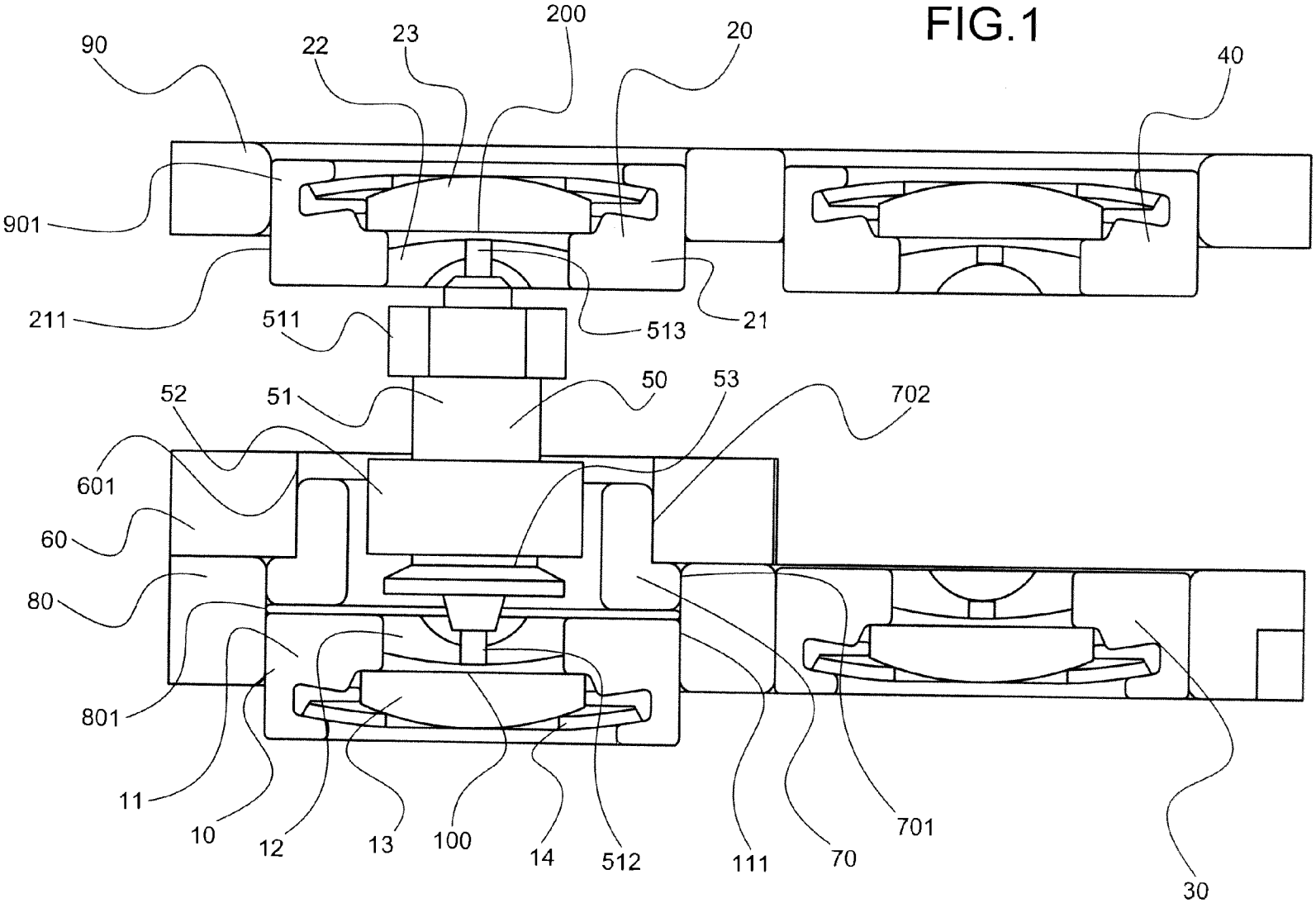
FIG. 1 is a cross sectional view of a rotor bearing structure according to the present invention.

With reference to FIG. 1, an embodiment of the present invention will be described. FIG. 1 is a cross sectional view of a rotor bearing structure according to the present invention. FIG. 1 depicts a cross sectional view that includes a rotor bearing in an electronic timepiece according to the present invention.

In FIG. 1, reference numerals 10, 20, 30, 40 are lubricating apparatuses that maintain lubrication and form bearings that support the staff of rotating components to enable rotation. In the embodiment, the lubricating apparatus 10 and the lubricating apparatuses 20, 30, 40 all have the same shape.

The lubricating apparatus 10 is configured by a substantially cylindrically shaped lubricating apparatus frame 11, a hole stone 12 that supports a rotor 50 in a horizontal direction as depicted in the drawing, an end stone 13 that supports the rotor 50 in a vertical direction as depicted in the drawing, and an end stone spring 14 that fixes the end stone 13 to the lubricating apparatus frame 11.

In FIG. 1, reference numeral 50 is a rotor that rotates 1 or more times in 1 second. The rotor 50 is configured by a rotor staff 51, a rotor magnet 52 that is fixed to the rotor staff 51, a rotor mount 53 that fixes the rotor magnet 52 to the rotor staff 51.

The rotor staff 51 has a rotor pinion 511 that is a gear, and that at each end, respectively has a pivot 512 and a pivot 513 inserted into the lubricating apparatuses 10 and 20 to enable rotation.

The pivot 512 is inserted into the hole stone 12 of the lubricating apparatus 10 to enable rotation and is lubricated by lubricant held in a given space 100 between end of the pivot 512 and an end of the end stone 13. Similarly, at the opposite side, the pivot 513 is inserted into a hole stone 22 of the lubricating apparatus 20 to enable rotation and is lubricated by lubricant held in a given space 200 between the end of the pivot 513 and an end of an end stone 23. Further, movement of the rotor 50 in a vertical direction as depicted in the drawing is restricted by the space 100 and the space 200.

The lubricant in the given space 100 is held therein by capillary action in a space between the outer periphery of the pivot 512 and the hole stone 12 and the space 100. Compared to a typical bearing, which is of a configuration lacking the end stone 13, the space 100 can hold more lubricant and prevent the spread of the lubricant. At the opposite side, the holding action of the lubricant is the same at the pivot 513 and the space 200.

The lubricating apparatus frame 11 of the lubricating apparatuses 10 to 40 has along the outer perimeter, a joint 111 that fits an opening 801 that is of a constant diameter and disposed along the rotational axis of the rotor 50, in a bottom plate 80.

In FIG. 1, reference numeral 60 is the stator. The stator 60 and the rotor 50 together with a non-depicted coil configure a motor.

When a central axis of an opening 601 of the stator 60 and the rotational axis of the rotor 50 are not aligned, performance of the motor having a configuration that includes the rotor 50 and the stator 60 deteriorates.

In FIG. 1, reference numeral 70 is the stator guide for aligning the central axis of an opening 601 of the stator 60 and the rotational axis of the rotor 50 with high precision.

The stator guide 70 has outer perimeter portions of at least 2 diameters, respectively. One portion is a joint 702 at the opening 601 of the stator 60 and the other portion is a joint 701 at the opening 801 of a constant diameter.

As depicted in FIG. 1, both the stator guide 70 and the lubricating apparatus 10 are fitted into the opening 801 of a constant diameter. Typically, since the degree of roundness and concentricity of the inner and outer perimeters of substantially cylindrically shaped components is maintained through production by a lathe process, even if the lubricating apparatus 10 and the stator guide 70 are respectively independent components, the respective central axes can be aligned with high precision.

Since the 2 components, the stator guide 70 and the lubricating apparatus 10, are both fitted into the opening 801 of a constant diameter, among the outer perimeter portion at the joint 701 and the outer perimeter portion at the joint 111, one has a larger diameter than the other. The reason for this is described.

Figure 2:
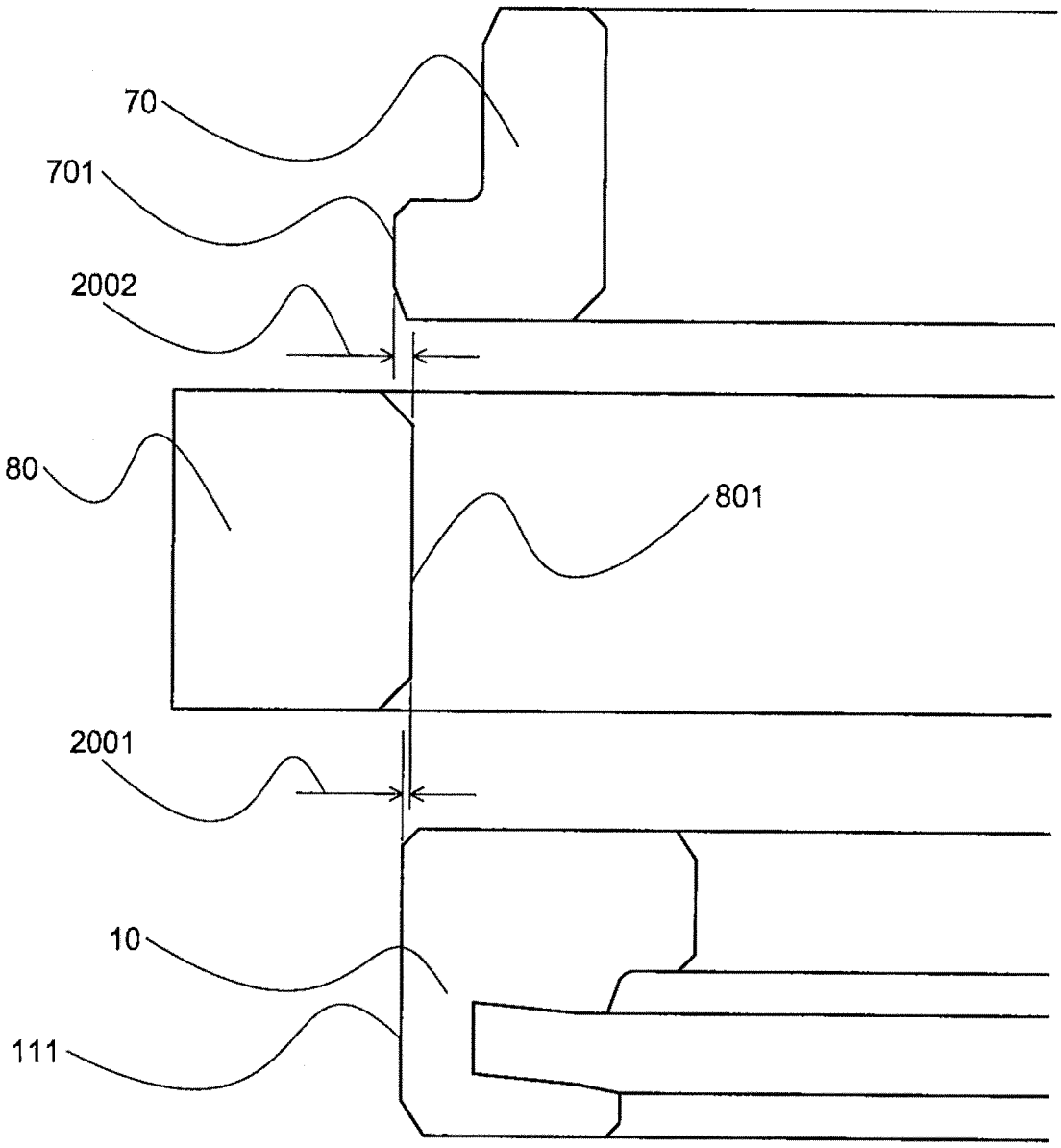
FIG. 2 is a diagram depicting relations between an inner diameter of an opening, an outer diameter at a joint of a lubricating apparatus and an outer diameter of a stator guide at a joint.

FIG. 2 is a diagram depicting the relations between the opening 801 of a constant diameter, the outer diameter of the lubricating apparatus at the joint 111 and the outer diameter of the stator guide 70 at the joint 701.

A length 2001 is ½ the difference of the diameter of the opening 801 and the outer diameter of the lubricating apparatus 10 at the joint 111. The length 2001 is approximately 0.4% of the diameter of the opening 801 and the diameter at the joint 111 is set to be approximately 0.8% larger than the diameter of the opening 801.

A length 2002 is ½ the difference of the diameter of the opening 801 and the outer diameter of the stator guide 70 at the joint 701. The length 2002 is set to be approximately 0.6% of the diameter of the opening 801 and the diameter at the joint 701 is set to be approximately 1.2% larger than the opening 801. In other words, the diameter of the stator guide 70 at the joint 701 is set to be greater than the diameter of the lubricating apparatus 10 at the joint 111, the respective diameters thereof are made to be different and both are fitted into the opening 801.

In the embodiment, the lubricating apparatus frame 11 is embedded into the opening 801 of the bottom plate 80, from the top as depicted in the drawing, to a given position. Thereafter, the stator guide 70 is inserted into the opening 801, from the top as depicted in the drawing. In other words, the outer diameter of the stator guide 70 at the joint 701 is greater than the outer diameter of the lubricating apparatus 10 at the joint 111, the lubricating apparatus 10 being fitted into the opening 801 before the stator guide 70. In this case, the lubricating apparatus frame 11 and the stator guide 70 are fitted into the opening 801 from the same direction and therefore, both can be embedded without changing the orientation of the bottom plate 80, improving ability. Nonetheless, the embedding is not limited hereto and, for example, the lubricating apparatus frame 11 may be fitted from the bottom as depicted in the drawing.

By inserting the lubricating apparatus frame 11 before the stator guide 70, the opening 801 widens to a minor extent consequent to friction with the lubricating apparatus frame 11 and elastic deformation of the bottom plate 80. Therefore, by making the outer diameter of the stator guide 70 at the joint 701 greater then the outer diameter of the lubricating apparatus frame 11 at the joint 111, a proper fit can be obtained.

Concerning the difference of the outer diameters at the joint 111 and the joint 701, although proper outer diameter differences differ according to the diameter of the opening 801 as well as the respective materials and shapes of the bottom plate 80, the lubricating apparatus frame 11, and the stator guide 70, a proper fit can be obtained by making either one of the outer diameters larger than the other.

The lubricating apparatus frame 21 is inserted into an opening 901 of a bridge 90, to a given position. Thereafter, the stator guide can be inserted into the opening 901 to a given position. In other words, the outer diameter at the joint of the stator guide, which is fitted into the opening 901 after the lubricating apparatus 20, is greater than the outer diameter at a joint 211 of the lubricating apparatus 20, which is fitted into the opening 901 before the stator guide.

Since the lubricating apparatus 10 is a structure where the hole stone 12 and the end stone 13 are fixed to the lubricating apparatus frame 11, the lubricating apparatus 10 can be used as the lubricating apparatus 20, which has the same shape as the lubricating apparatus 10, for a bearing on the side opposite of the bottom plate 80. Further, even for bearings having a different gear, the lubricating apparatus 10 can be used as the lubricating apparatus 30 and the lubricating apparatus 40, which have the same shape as the lubricating apparatus 10.

The structure of the bearing of the rotor according to the invention drives an n-rotations rotor that rotates 2 or more times in 1 second, and is useful in bearing structures that rotate a rotor at a high speed such as an electronic timepiece that divides the distance moved by the seconds hand in 1 second into 1/n to advance the seconds hand n steps within 1 second such that the seconds hand appears to advance smoothly.

In an electronic timepiece that advances the seconds hand to appear to move smoothly, the number of rotations of the rotor is greater than that for a typical electronic timepiece, which drives the rotor 1 time per second, and consequently, lubricant may spread. Thus, an inability to maintain a proper lubrication state of the rotor bearing can be expected. Further, since the number of rotations of the rotor is greater than that for a typical electronic timepiece, the axial center of the opening of the stator and the rotational axis of the rotor have to be aligned with high precision to reduce the consumption current of the motor while maintaining performance.

Use of the structure of the rotor bearing according to the invention enables the lubrication state of the rotor bearing to be maintained, the axial center of the opening of the stator and the rotational axis of the rotor to be aligned with high precision, and makes processing easy since the shapes of the components are simple.

As described, the invention, in an electronic timepiece having at least a rotor and a stator, has disposed in the bottom plate, which is a primary member of the electronic timepiece, a substantially cylindrically shaped lubricating apparatus disposed as the bearing of the rotor and to hold lubricant, and a substantially cylindrically shaped stator guide for maintaining the position of the stator. The invention further has a cylindrically shaped opening for substantially aligning and fixing the central axes of the lubricating apparatus and stator guide, where the outer diameter at the joint between the opening and the fitted lubricating apparatus and the outer diameter at the joint between the opening and the fitted stator guide differ.

The rotor bearing structure according to the invention is assembled by respectively fitting into the opening of a constant diameter, the lubricating apparatus and the stator guide and thus, an axial core of the rotor and the opening of the stator can be aligned with high performance while making the shape of the lubricating apparatus and the stator guide simple as well as simplifying the processing of the lubricating apparatus and the stator guide.

Further, the present invention disposes multiple lubricating apparatuses in the electronic timepiece, where the rotor uses at least 2 of the lubricating apparatuses as a bearing.

According to the rotor bearing structure of the invention, even for a rotor that uses multiple lubricating apparatuses, the axial core of the rotor and the opening of the stator are aligned with high precision while the shapes of the lubricating apparatus and the stator guide are simple and the processing of the lubricating apparatus and the stator guide are simplified.

The invention has a characteristic in that, which ever is fitted into the opening last among the lubricating apparatus and the stator guide, has an outer diameter at the joint that is greater than the other fitted into the opening first.

According to the rotor bearing structure of the invention, among the lubricating apparatus and stator guide, which ever has the smaller the outer diameter at the joint, is embedded first followed by the other. Thus, even if the diameter of the opening is wide, which ever is embedded first, the lubricating apparatus or the stator guide, prevents the problem of the fit of the lubricating apparatus or the stator guide, which ever is embedded after, from being loose.

The invention has a characteristic in that the lubricating apparatus is fitted into the opening before the stator guide.

Further, to achieve the objects above, the invention has a characteristic in that the lubricating apparatus is used as a bearing for the bearing on the side opposite the bearing that the stator guide has for the rotor.

According to the rotor bearing structure of the invention, the lubricating apparatus does not need a guide member for positioning the opening of the stator and therefore, the lubricating apparatus can be used as for the other bearings and since the lubricating apparatus can be used for other bearings requiring the holding of lubricant, an increase in the types of components can be prevented.

INDUSTRIAL APPLICABILITY

As described, the electronic timepiece according to the embodiment is useful for electronic timepieces having at least a rotor and a stator and is particularly suitable for electronic timepieces having a stator and a rotor that rotates 1 or more times in 1 second.

EXPLANATIONS OF LETTERS OR NUMERALS

10, 20, 30, 40 lubricating apparatus
50 rotor
60 stator
70 stator guide
80 bottom plate
90 bridge

The invention claimed is:

1. A method for manufacturing an electronic timepiece having a rotor; a stator; a lubricating apparatus that has a substantially cylindrical shape and is disposed as a bearing of the rotor and for holding lubricant; and a stator guide that has a substantially cylindrical shape and is for maintaining a position of the stator, the method comprising:

fitting and fixing the lubricating apparatus and the stator guide such that respective central axes are aligned to an opening that has a substantially cylindrical shape and is disposed in a bottom plate that is a primary member of the electronic timepiece, wherein prior to the lubricating apparatus and the stator guide being fitted into the opening, an outer diameter at a joint of the lubricating apparatus and an outer diameter at a joint of the stator guide differ.

2. The method according to claim 1, wherein the lubricating apparatus is disposed in plural in the electronic timepiece, and the rotor uses at least two of the lubricating apparatuses as the bearing.

3. The method according to claim 1, wherein any one of the lubricating apparatus and the stator guide is first fit into the opening as a first fit, and the other of the lubricating apparatus and the stator guide is fit into the opening as a subsequent fit, and wherein the outer diameter at the joint of the subsequent fit is greater than the outer diameter at the joint of the first fit.

4. The method according to claim 3, wherein the first fit is the lubricating apparatus and the subsequent fit is the stator guide.

* * * * *